US006968068B1

(12) United States Patent
Amsel

(10) Patent No.: US 6,968,068 B1
(45) Date of Patent: Nov. 22, 2005

(54) FOLDABLE SPEAKERS

(75) Inventor: Allan Amsel, Edison, NJ (US)

(73) Assignee: Sakar International, Inc., Edison, NJ (US)

( * ) Notice: Subject to any disclaimer, the term of this patent is extended or adjusted under 35 U.S.C. 154(b) by 0 days.

(21) Appl. No.: 11/034,291

(22) Filed: Jan. 12, 2005

(51) Int. Cl.[7] ..... H04R 25/00

(52) U.S. Cl. ..... 381/334; 381/333; 381/335; 381/387; 381/390

(58) Field of Search ..... 381/300, 301, 381/306, 87, 89, 332–336, 182, 186, 386–388, 381/390; 181/141, 144, 145, 147, 199; 248/176.3, 248/284.1, 276.1, 278.1, 290.1, 291.1

(56) References Cited

U.S. PATENT DOCUMENTS 6,600,827 B2 * 7/2003 Lu ..... 381/388
6,608,909 B2 * 8/2003 Brady ..... 381/387

* cited by examiner

*Primary Examiner*—Huyen Le

(74) *Attorney, Agent, or Firm*—Ezra Sutton, Esq.

(57) ABSTRACT

A foldable speaker system, including an elongated base member having a first end and a second end; a first speaker member having a first pivoting end and being pivotally connected to the first end of the base member, wherein the first speaker member is pivotally movable between a first closed position co-linear with the base member and a second vertical position; and a second speaker member having a second pivoting end and being pivotally connected to the second end of the base member, wherein the second speaker member is pivotally movable between a first closed position co-linear with the base member and a second vertical position. The first and second speaker members in their first closed positions, respectively, substantially overlap the base member, so that the non-pivoting second ends of the first and second speakers are adjacent to each other. The first and second speaker members in the second vertical positions, respectively, are unfolded and are vertically arranged and perpendicular to the base member. The foldable speaker system also includes a speaker stand pivotally connected to the base member so that the speaker stand is pivotally movable between a first position wherein the speaker stand is co-linear with the base member, and a second position wherein the speaker stand is in an unfolded and supporting position to support the base member and the first and second speaker-members in the unfolded and vertical position.

16 Claims, 8 Drawing Sheets

FOLDABLE SPEAKERS

FIELD OF THE INVENTION

The present invention relates to a foldable speaker system having a pair of speakers that rotate relative to a base. More particularly, each of the speakers pivot relative to the base between a folded horizontal position which is co-linear with and overlapping the base, to an open vertical position. In addition, a speaker stand is pivotally attached to the base, such that the speaker stand pivots about the base from a closed position to an extended position.

BACKGROUND OF THE INVENTION

Collapsible and portable speaker assemblies are well known in the art, and such assemblies have been configured into many forms. Existing speaker assemblies and speaker systems that are collapsible as well as being portable in design have been generally bulky, heavy and costly to manufacture and such assemblies because of their elongated configuration are not conveniently stored or transported from one destination to another.

There remains a need for a foldable speaker assembly where each of the two speakers pivot relative to a base section and fold between a horizontal position (the speakers are co-linear with and overlapping the base) and a vertical open position. Further, the foldable speaker assembly includes a speaker stand being pivotally attached to the base section, such that the speaker stand pivots about the base section from a closed position to an extended position.

DESCRIPTION OF THE PRIOR ART

Foldable, collapsible and portable speaker assemblies or speaker systems and the like having various designs, structures, configurations and materials of construction have been disclosed in the prior art. For example, U.S. Pat. No. 4,042,778 discloses a collapsible speaker assembly that is formed by a split case in which a plurality of individual speakers are mounted. The split case is formed by two mating shells which are pivotally connected together at one side. When the shells are opened in 180 relationship with each other, a sound column is formed in which the speakers are held in a generally linear array. In use, the sound column is held in a vertical position for improved dispersion of sound in the horizontal plane of an audience. This prior art patent does not disclose or teach the structure of the foldable speaker system by the present invention.

U.S. Pat. No. 4,884,655 discloses a tower-type speaker cabinet assembly for plural speakers of a high fidelity audio system. The speaker assembly includes a vertically elongated tower cabinet having a pair of front wall segments adjacent the uppermost and lowermost ends of the tower speaker cabinet. The speaker assembly includes a vertically elongated tower cabinet. Also included is an intermediate forwardly opening cavity extending between the upper and lower front wall segments. In addition, a pair of vertically spaced large subwoofer speakers in the respective upper and lower front wall segments with associated inner cabinets forming sound boxes are also included. Further, a swivelled movable center subcabinet spans the vertical distance between the front wall segments, and has a woofer, a mid-bass speaker, and a pair of tweeters carried by a front wall portion of the center subcabinet. The subcabinet has a range of swivel-movement horizontally through predetermined angles about a vertical axis located a short distance rearwardly from the front wall of the swivelled subcabinet. Shock absorber strips are provided between the inner cabinets and the outer cabinet for minimizing vibration transfer therebetween. This prior art patent does not disclose or teach the structure of the foldable speaker system of the present invention.

U.S. Pat. No. 6,101,261 discloses an enclosure that has one or more loud speakers therein adjacent the front of the enclosure; and the back of the enclosure defines an opening. A pair of tilt members are mounted on inner surfaces of the enclosure at opposite sides thereof for sliding and rotating movement with respect to the enclosure. The tilt members each include an elongated straight portion and an offset portion at one end of the straight portion. The tilt members are stored completely within the enclosure and may be adjusted to extend through and rearwardly of the opening at the rear of the enclosure to engage a support surface. A locking member locks each tilt member in adjusted position. Electronic means for operating the loud speakers may be disposed within the enclosure at the top thereof. This prior art patent does not disclose or teach the structure of the foldable speaker system of the present invention.

U.S. Pat. No. 6,608,909 discloses a speaker rack for use with spas including a first and second member with the second member comprising generally extending members. The first member is coupled to the generally extending members of the second member. This first member allows for support, helps an individual move the speaker rack into different positions easily and acts as a place to hang towels, clothing and the like. Multi-position detents attach to the second member and allow for the speaker rack to be placed in an extreme upward position, an extreme downward position and positions in between. Speakers that can be swivelled and pivotally mounted attach to speaker attachment means on the generally extending members of the second member and speaker wiring may run through an aperture in the second member and attach to an output device allowing for entertainment while in or around the spa. This prior art patent does not disclose or teach the structure of the foldable speaker system of the present invention.

None of the aforementioned prior art references disclose or teach the specific structure of the foldable speaker system of the present invention of having two speakers that are co-linear with and overlapping a base section wherein each of the speakers pivot relative to the base section and fold between a horizontal position and a vertical open position.

Accordingly, it is an object of the present invention to provide a foldable speaker system having a pair of speakers that rotate relative to a base section.

Another object of the present invention is to provide a foldable speaker system wherein each of its speakers pivot relative to its base section between a folded horizontal position, which is co-linear with and overlapping the base section, to an open vertical position.

Another object of the present invention is to provide a foldable speaker system that includes a speaker stand being pivotally attached to the base section, wherein the speaker stand pivots about the base section from a closed position to an extended position for supporting the speaker system in its assembled and operational state.

Another object of the present invention is to provide a foldable speaker system that is compact, light-weight in design, and convenient to store or transport.

Another object of the present invention is to provide a foldable speaker system that can be mass produced in an automated and economical manner and is readily affordable by the consumer.

SUMMARY OF THE INVENTION

In accordance with the present invention, there is provided a foldable speaker system, including an elongated base member having a first end and a second end; a first speaker member having a first pivoting end and being pivotally connected to the first end of the base member, wherein the first speaker member is pivotally movable between a first closed position co-linear with the base member and a second vertical position; and a second speaker member having a first pivoting end and being pivotally connected to the second end of the base member, wherein the second speaker member is pivotally movable between a first closed position co-linear with the base member and a second vertical position. The first and second speaker members in their first closed positions, respectively, substantially overlap the base member, so that the non-pivoting second ends of the first and second speakers are adjacent to each other. The first and second speaker members in the second vertical positions, respectively, are unfolded and are vertically arranged and perpendicular to the base member. The foldable speaker system also includes a speaker stand pivotally connected to the base member so that the speaker stand is pivotally movable between a first position wherein the speaker stand is co-linear with the base member, and a second position wherein the speaker stand is in an unfolded and supporting position to support the base member and the first and second speaker members in the unfolded and vertical position.

BRIEF DESCRIPTION OF DRAWINGS

Further objects, features and advantages of the present invention will become apparent upon the consideration of the following detailed description of the presently preferred embodiment when taken in conjunction with the accompanying drawings, wherein.

DETAILED DESCRIPTION OF THE PREFERRED EMBODIMENT

The portable and foldable speaker system 10 and its component parts of the preferred embodiment of the present invention is represented in detail by FIGS. 1 to 8 of the patent drawings. The foldable speaker system 10 is a portable, compact and foldable speaker system 10 for use by the consumer at home, work or in the outdoors at picnics, sporting events, concerts and the like.

Figure 1:
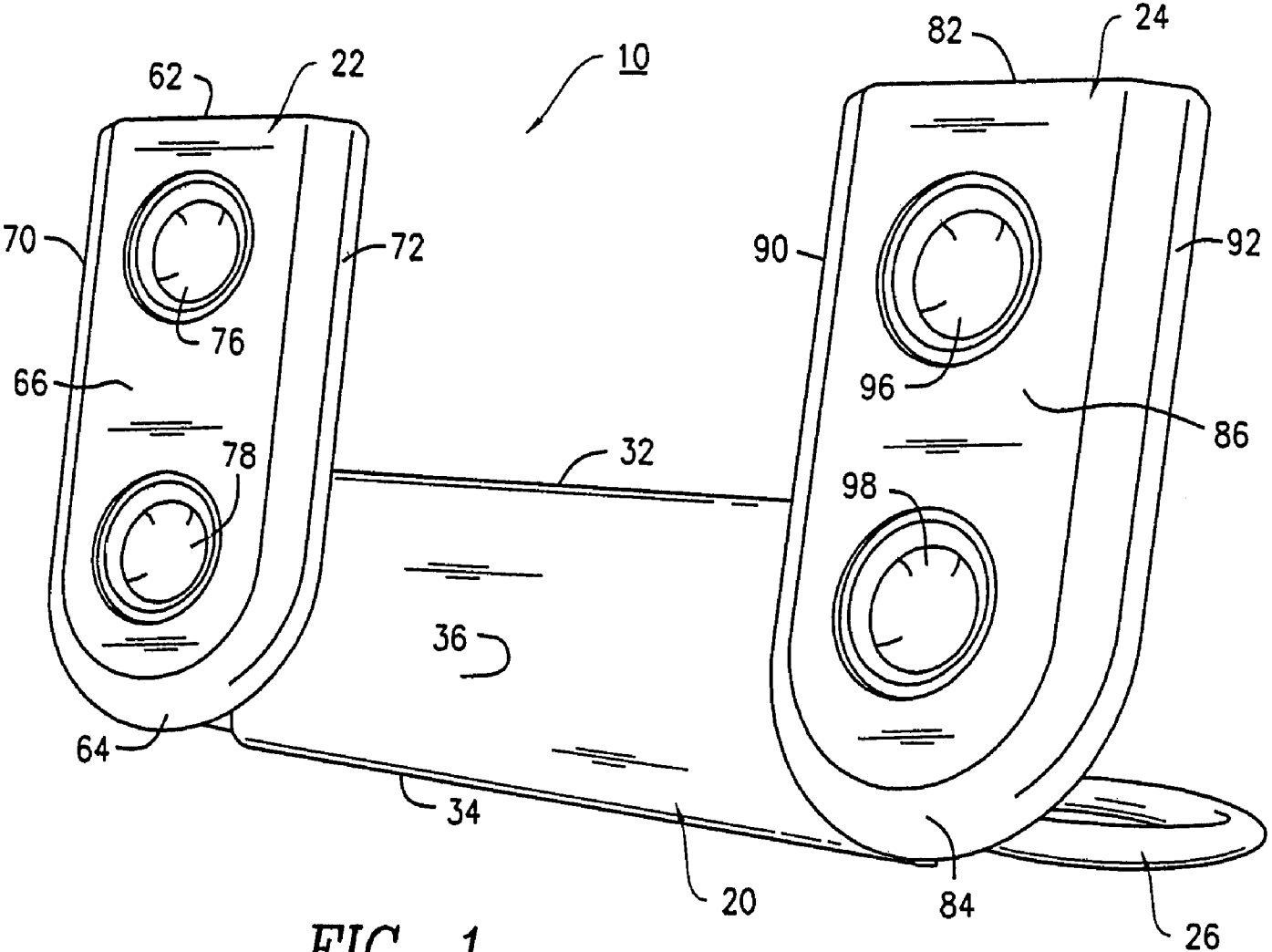
FIG. 1 is a front perspective view of the foldable speaker system of the preferred embodiment of the present invention showing the major component parts thereon in an open and unfolded configuration and in operational use thereof.
Figure 5:
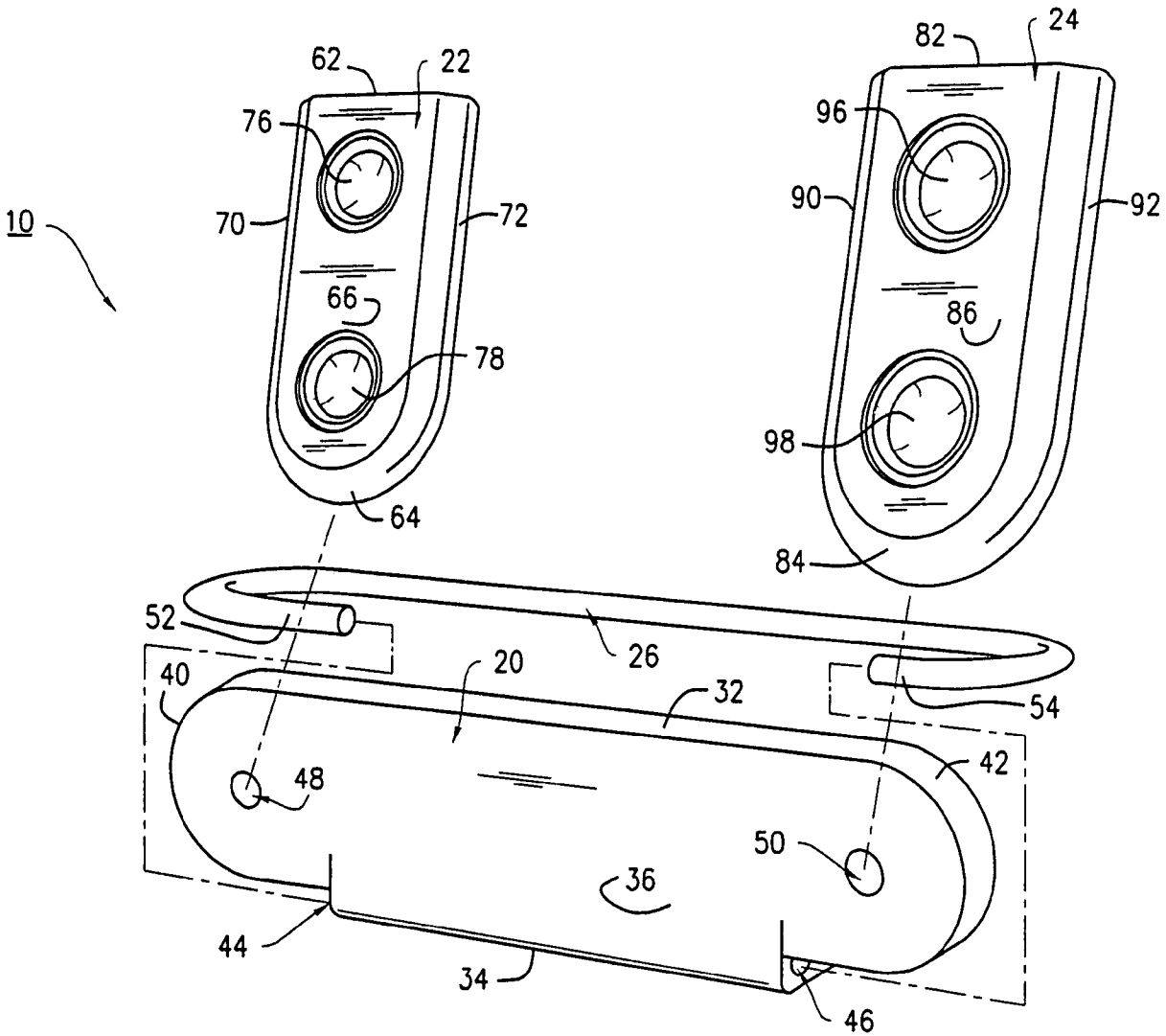
FIG. 5 is a front exploded perspective view of the foldable speaker system of the present invention showing all of its major component parts thereto.
Figure 6:
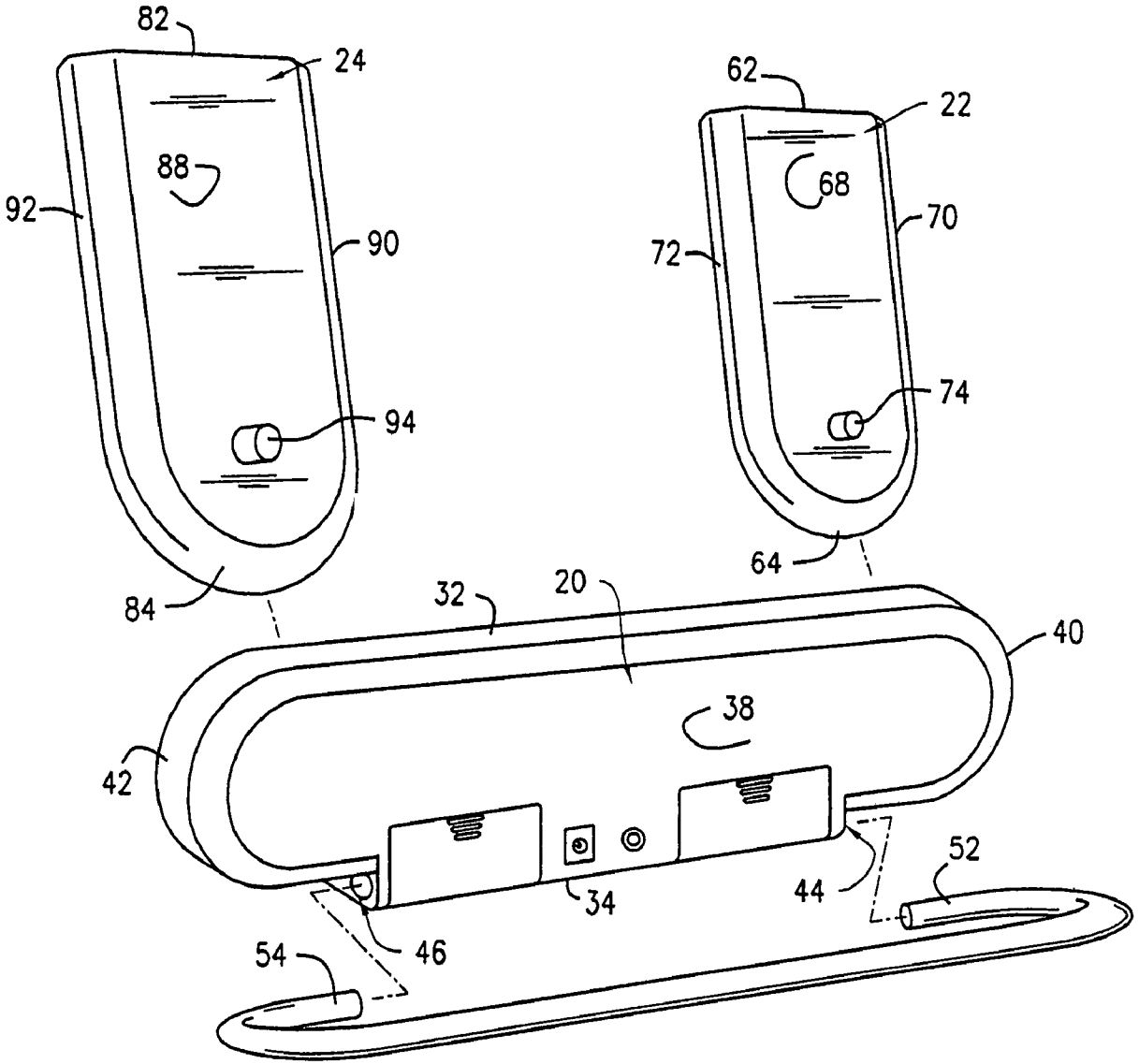
FIG. 6 is a rear exploded perspective view of the foldable speaker system of the present invention showing all of its major component parts thereto.

The foldable speaker system 10, as shown in FIGS. 1, 5 and 6, includes a base member 20, a first speaker member 22, a second speaker member 24 and a speaker stand 26 for forming the foldable speaker system 10. Base member 20 includes a top wall 32, a bottom wall 34, a front wall 36, a rear wall 38, and side walls 40 and 42. Side walls 40 and 42 each include a stand opening 44 and 46, respectively. Base member 20 may be rectangularly-shaped, ovally-shaped or combinations thereof.

Figure 2:
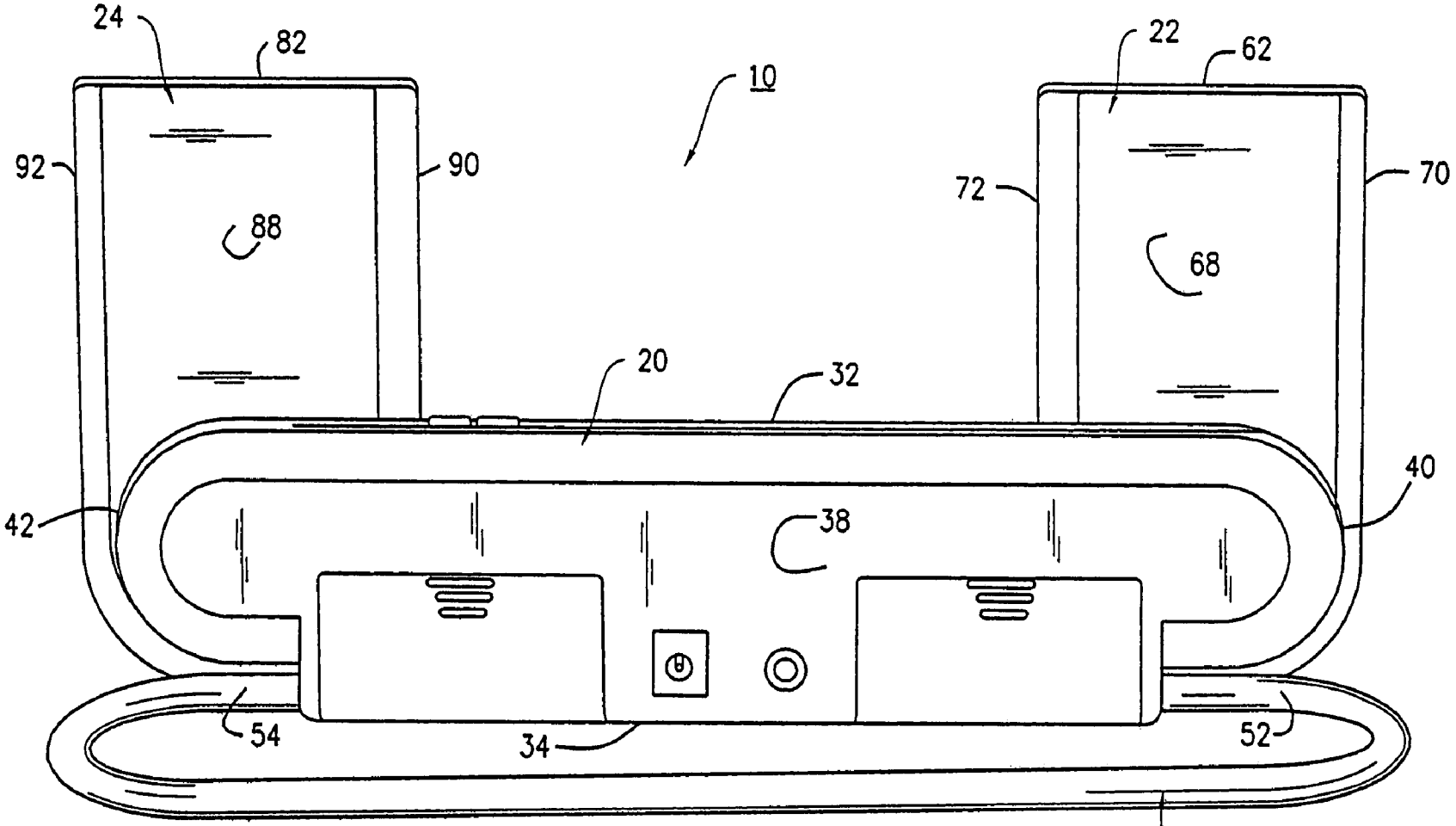
FIG. 2 is a rear perspective view of the foldable speaker system of the present invention showing a speaker stand in an extended open position and in operational use thereof.
Figure 4:
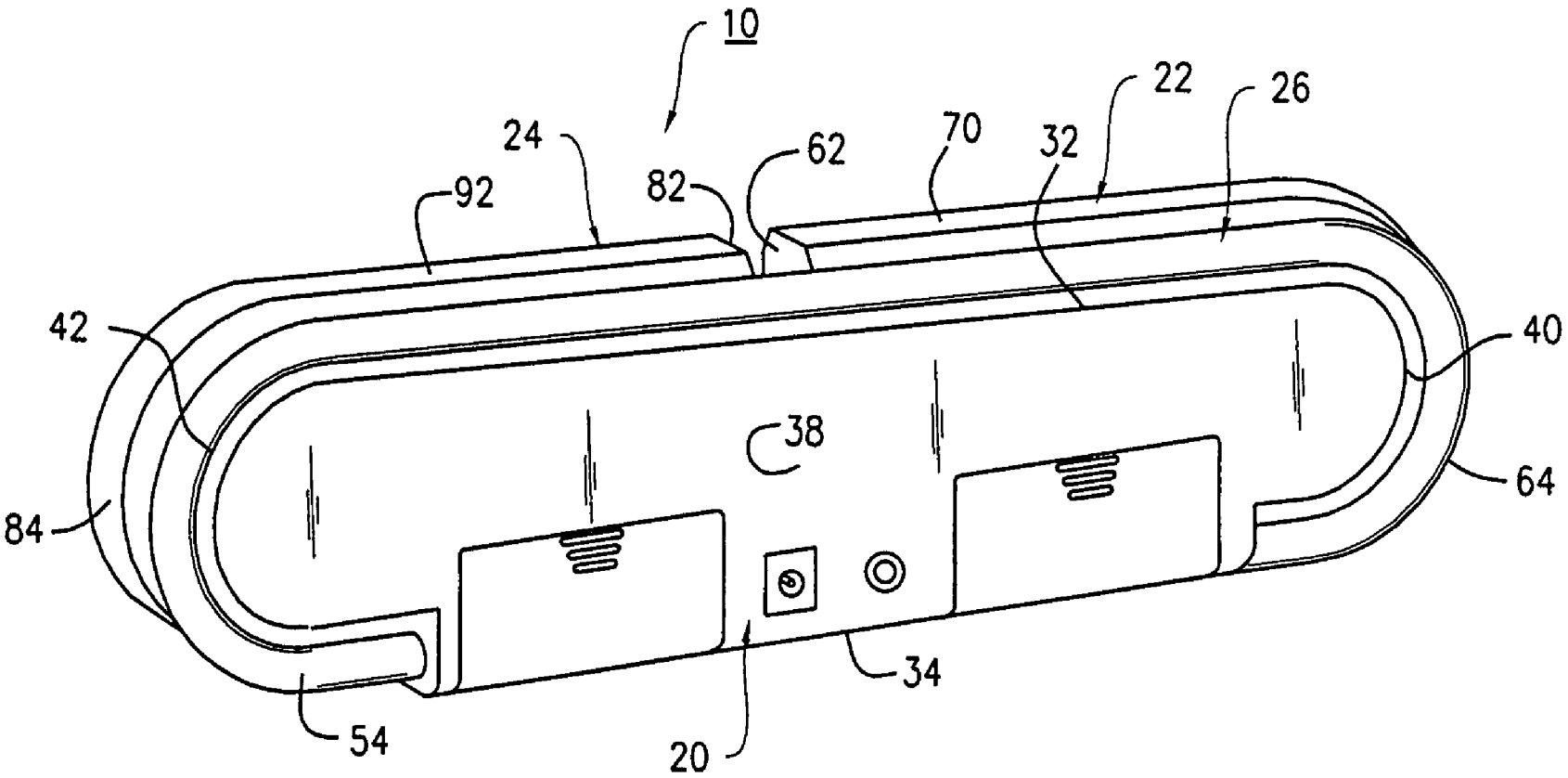
FIG. 4 is a rear perspective view of the foldable speaker system of the present invention showing the speaker stand in a closed configuration relative to its base section.

Speaker stand 26 is substantially oval-shaped and has a first stand end 52 and a second stand end 54. Each of the stand ends 52 and 54 is detachably received within stand openings 44 and 46, respectively. Stand ends 52 and 54 are pivotally connected to stand openings 44 and 46 for rotatably moving the speaker stand 26 about the base member 20 from a closed position $P_1$, to an extended position $P_2$, as shown in FIGS. 4 and 2, respectively.

Front wall 36 of base member 20 includes opposing pivot openings 48 and 50 being adjacent to each side wall 40 and 42, respectively. The opposed pivot openings 48 and 50 are used to pivotally connect each of the first and second speaker members 22 and 24, respectively, to the base member 20, as shown in FIGS. 1, 5 and 6 of the patent drawings.

Speaker stand 26 may be made of durable and rigid plastic materials or made from light-weight metal materials, such as aluminum or stainless steel.

Figure 3:
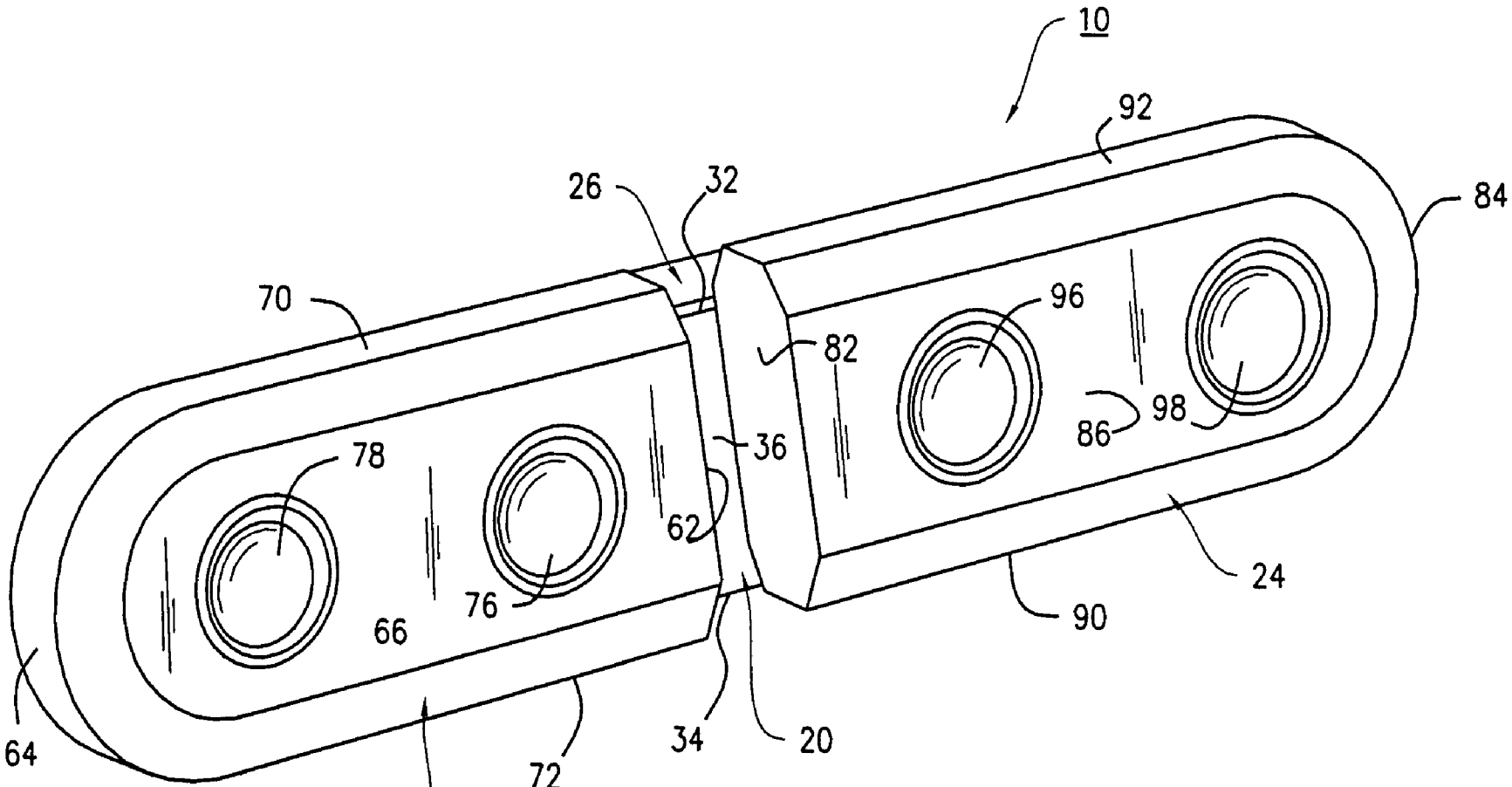
FIG. 3 is a front perspective view of the foldable speaker system of the present invention showing a pair of speakers in a closed configuration relative to a base section.
Figure 7:
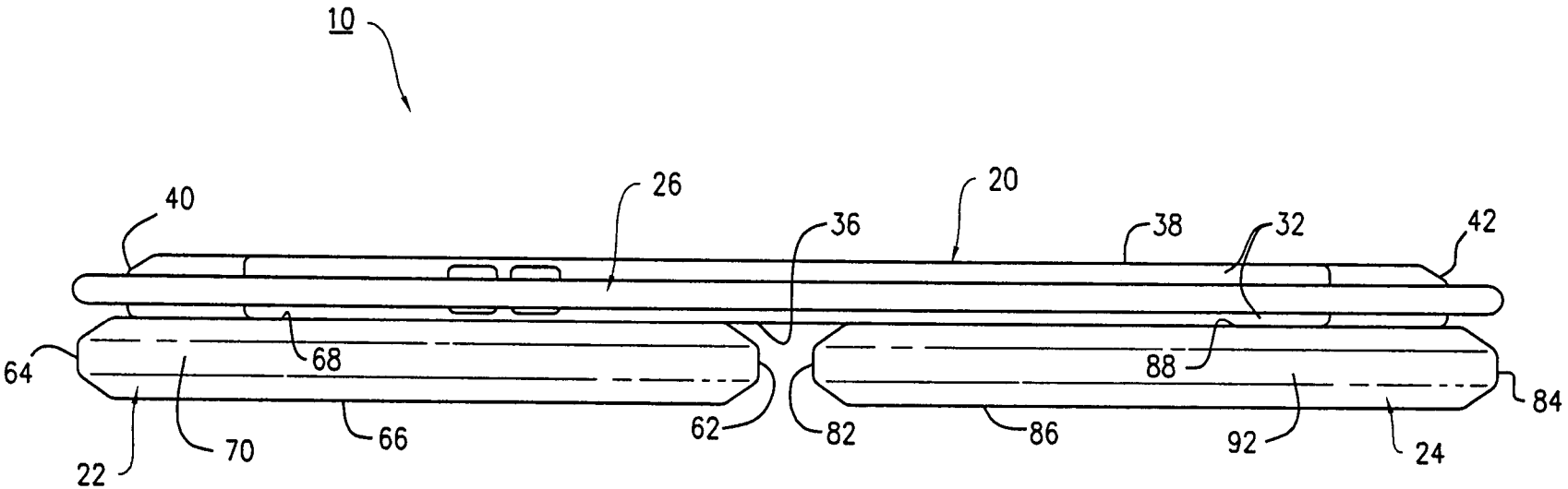
FIG. 7 is a top plan view of the foldable speaker system of the present invention showing each of the speaker members being in a co-linear and overlapping relationship to its base section in a closed configuration.
Figure 8:
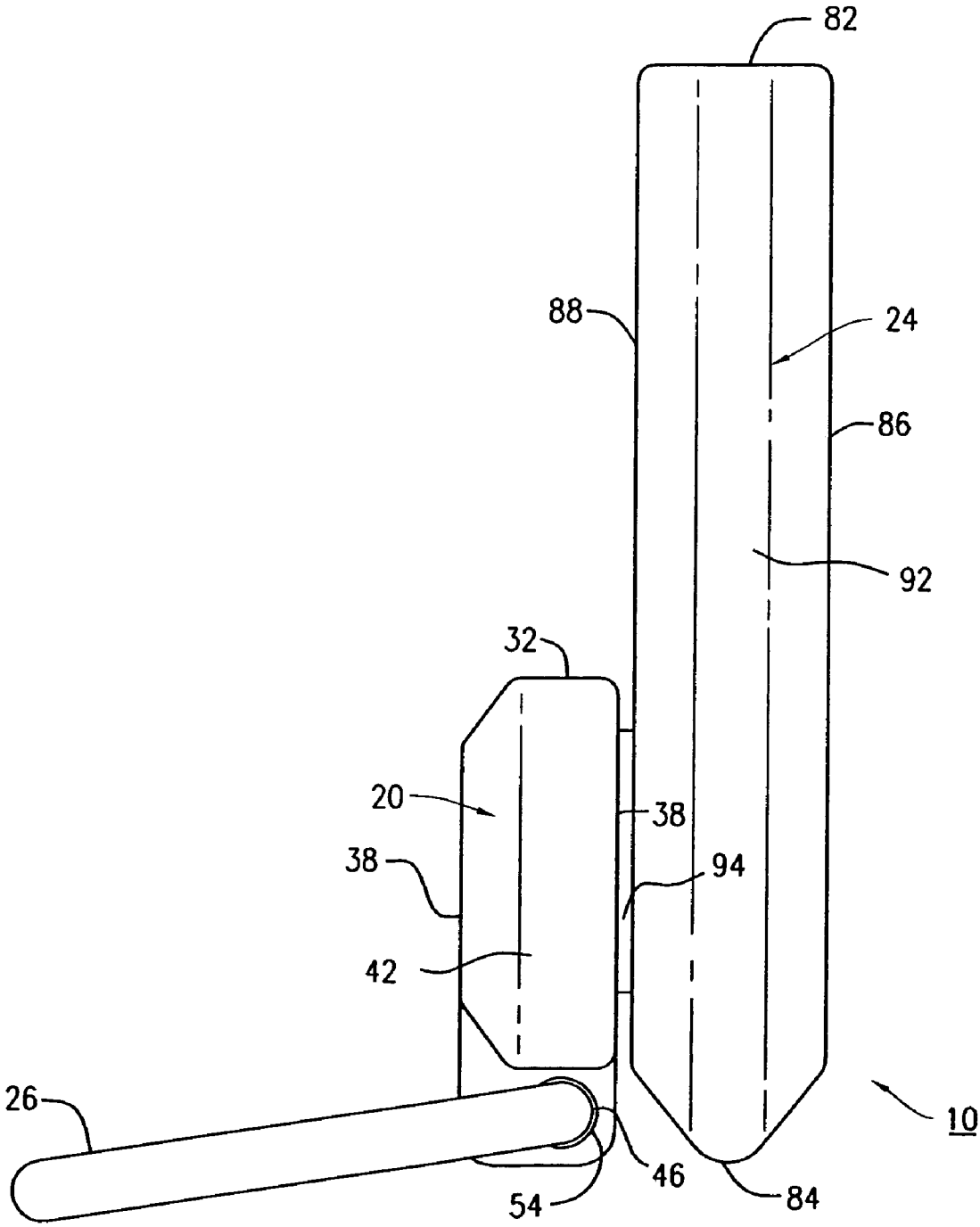
FIG. 8 is a side elevational view of the foldable speaker system of the present invention showing the speaker stand in a co-linear relationship to its base section in an open and unfolded configuration.

First speaker member 22 includes a top end wall 62, a bottom end wall 64, a front wall 66, a rear wall 68 and side walls 70 and 72. Rear wall 68 includes a pivot tab member 74 being centrally located and adjacent to the bottom end wall 64, as shown in FIG. 6. Pivot tab member 74 of the first speaker member 22 is pivotally connected to pivot opening 48 of base member 20 for rotatably moving the first speaker member 22 in a 90° arc angle alpha ($\alpha$) from a closed horizontal position $S_1$ to an open unfolded vertical position $S_2$, as shown in FIGS. 1 and 3 of the patent drawings. As shown in FIGS. 7 and 8, the first speaker member 22 is co-linear with and overlaps the base member 20 relative to its pivoting of the speaker member 22 in a counter-clockwise rotation $C_1$. The front wall 66 of first speaker member 22 includes a pair of spaced-apart and aligned speaker elements 76 and 78 for outputting sound from speaker member 22.

Second speaker member 24 includes a top end wall 82, a bottom end wall 84, a front wall 86, a rear wall 88 and side walls 90 and 92. Rear wall 88 includes a pivot tab member 94 being centrally located and adjacent to the bottom end wall 84, as shown in FIG. 6. Pivot tab member 94 of the second speaker member 24 is pivotally connected to pivot opening 50 of base member 20 for rotatably moving the second speaker member 24 in a 90° arc angle beta ($\beta$) from a closed horizontal position $S_3$ to an open unfolded vertical position $S_4$, as shown in FIGS. 1 and 3 of the patent drawings. As shown in FIG. 7, the second speaker member 24 is co-linear with and overlaps the base member 20 relative to its pivoting of speaker member 24 in a clockwise rotation $C_2$. The front wall 86 of second speaker member 24 includes a pair of spaced-apart and aligned speaker elements 96 and 98 for outputting sound from speaker member 24. Each of the speaker members 22 and 24 may be rectangularly-shaped, ovally-shaped or combinations thereof.

OPERATIONS OF THE PRESENT INVENTION

In operating the foldable speaker system 10, as shown in FIGS. 1 through 4 of the drawing, the user operates this speaker system 10 in the following manner. Initially, the user starts the operation when the foldable speaker system 10 is in the closed configuration $S_1$ and $S_3$ for speaker members 22 and 24, as well as a closed configuration $P_1$ for speaker stand 26, as shown in FIGS. 3 and 4 of the drawings. The user now pivotally rotates the speaker stand 26 about the base section member 20 in a clockwise rotation $C_3$ in a 90° arc angle gamma (γ) from a closed position $P_1$ to an extended position $P_2$ for positioning the base member 20 and speaker stand 26 on the ground, table or any other level surface 12, as shown in FIG. 8.

Next, the user pivotally rotates each of the speaker members 22 and 24 in a counter-clockwise rotation $C_1$, and a clockwise rotation $C_2$, such that each of the speaker members 22, 24 rotates about 90° arc angles alpha (α) and beta (β), respectively, from a closed folded horizontal position $S_1$ to an open unfolded vertical position $S_2$, as shown in FIGS. 1 and 3 of the patent drawings. The foldable speaker system 10 is now in its fully assembled state and in an operational mode thereof. In unassembling to a non-operational mode, the user simply reverses the aforementioned steps of the foldable speaker system 10 to its closed configuration as shown in FIGS. 3 and 4 of the drawings.

ADVANTAGES OF THE PRESENT INVENTION

Accordingly, an advantage of the present invention is that it provides for a foldable speaker system having a pair of speakers that rotate relative to a base section.

Another advantage of the present invention is that it provides for a foldable speaker system wherein each of its speakers pivot relative to its base section between a folded horizontal position, which is co-linear with and overlapping the base section, to an open vertical position.

Another advantage of the present invention is that it provides for a foldable speaker system that includes a speaker stand being pivotally attached to the base section, wherein the speaker stand pivots about the base section from a closed position to an extended position for supporting the speaker system in its assembled and operational state.

Another advantage of the present invention is that it provides for a foldable speaker system that is compact, light-weight in design, and convenient to store or transport.

Another advantage of the present invention is that it provides for a foldable speaker system that can be mass produced in an automated and economical manner and is readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A foldable speaker system, comprising:

a) an elongated base member having a first end and a second end;

b) a first speaker member having a pivoting first end and a non-pivoting second end, said pivoting first end of said first speaker member being pivotally connected to said first end of said base member, wherein said pivoting first end of said first speaker member is pivotally movable between a closed first position co-linear with said base member and an opened and unfolded second position perpendicular to said base member;

c) a second speaker member having a pivoting second end and a non-pivoting second end, said pivoting second end of said second speaker member being pivotally connected to said second end of said base member, wherein said pivoting second end of said second speaker member is pivotally movable between a closed first position co-linear with said base member and an opened and unfolded second position perpendicular to said base member;

d) said first and second speaker members in said closed first positions, respectively, substantially overlap said base member, so that said non-pivoting second ends of said first and second speaker members are adjacent to each other, and wherein said first and second speaker members, in said opened and unfolded second positions, respectively, are vertically arranged and perpendicular to said base member; and e) a speaker stand pivotally connected to said base member so that said speaker stand is pivotally movable between a first position wherein said speaker stand is co-linear with said base member, and a second position wherein said speaker stand is in an unfolded and supporting position to support said base member and said first and second speaker members in said unfolded and supporting position.

2. A foldable speaker system in accordance with claim 1, wherein said base member includes a front wall, a rear wall, a top wall, a bottom wall and side walls.

3. A foldable speaker system in accordance with claim 2, wherein said speaker stand is pivotally connected to each of said side walls of said base member.

4. A foldable speaker system in accordance with claim 2, wherein each of said first and second speaker members are pivotally connected to said opposing first and second ends, respectively, of said front wall of said base member.

5. A foldable speaker system in accordance with claim 2, wherein said first speaker member rotatably moves in a counter-clockwise rotation and in a 90° arc angle alpha (α) from a closed horizontal position to an open unfolded vertical position relative to said front wall of said base member.

6. A foldable speaker system in accordance with claim 2, wherein said second speaker member rotatably moves in a clockwise rotation and in a 90° arc angle beta (β) from a closed horizontal position to an open unfolded vertical position relative to said front wall of said base member.

7. A foldable speaker system in accordance with claim 2, wherein said speaker stand pivotally rotates in a clockwise rotation and in a 90° arc angle gamma (γ) from said first position to said second position relative to said rear wall of said base member for positioning said base member on a level surface.

8. A foldable speaker system in accordance with claim 1, wherein said base member is substantially rectangularly-shaped.

9. A foldable speaker system in accordance with claim 1, wherein said base member is substantially ovally-shaped.

10. A foldable speaker system in accordance with claim 1, wherein one of said first or second ends of said base member has a curved end.

11. A foldable speaker system in accordance with claim 1, wherein each of said first and second speaker members include a front wall, a rear wall, a top wall, a bottom wall and side walls.

12. A foldable speaker system in accordance with claim 11, wherein one of said side walls has a curved end and said other side wall has a straight-edged end.

13. A foldable speaker system in accordance with claim 11, wherein said front wall of each of said first and second speaker members includes a pair of spaced-apart and aligned speaker elements for outputting sound by said speaker elements.

14. A foldable speaker system in accordance with claim 1, wherein each of said first and second speaker members are substantially rectangularly-shaped.

15. A foldable speaker system in accordance with claim 1, wherein each of said first and second speaker members are substantially ovally-shaped.

16. A foldable speaker system in accordance with claim 1, wherein said speaker stand is made from durable and rigid plastics or made from light-weight metal of aluminum or stainless steel.

* * * * *